United States Patent [19]

Scarbrough, Jr.

[11] 4,184,161

[45] Jan. 15, 1980

[54] ANTENNA SYSTEM FOR A MOTOR VEHICLE

[76] Inventor: John D. Scarbrough, Jr., 234-52 First St., Piqua, Ohio 45356

[21] Appl. No.: 811,525

[22] Filed: Jun. 30, 1977

Related U.S. Application Data

[63] Continuation-in-part of Ser. No. 786,589, Apr. 11, 1977, abandoned.

[51] Int. Cl.[2] ..... H01Q 1/32

[52] U.S. Cl. ..... 343/713; 343/750

[58] Field of Search ..... 343/711–713, 343/750, 743

[56] References Cited

U.S. PATENT DOCUMENTS

| | | | |
|---|---|---|---|
| 2,520,986 | 9/1950 | Williams et al. | 343/712 |
| 3,142,064 | 7/1964 | Hughes et al. | 343/860 |
| 3,210,766 | 10/1965 | Parker | 343/712 |

*Primary Examiner*—David K. Moore

*Attorney, Agent, or Firm*—Jacox & Meckstroth

[57] ABSTRACT

A motor vehicle is provided with a transceiver which is coupled to a rear mounted antenna system constructed to be unobtrusive and virtually undetectable in addition to being a good radiator.

7 Claims, 3 Drawing Figures

ANTENNA SYSTEM FOR A MOTOR VEHICLE

RELATED APPLICATION

This application is a continuation-in-part of U.S. patent application Ser. No. 786,589, filed Apr. 11, 1977, and now abandoned.

BACKGROUND OF THE INVENTION

In the past, the only two-way radio transceivers in an automobile, aside from those associated with fire or police departments, were amateur radio (Ham) operators or the occasional business man with a mobile telephone system. The Ham antenna, which operates in the 80 through 10 meter bands is about 9-10 feet tall and usually has a conspicuous center loading coil. Nevertheless, rarely was either the antenna or the mobile transceiver equipment disturbed by the criminal element, probably due to the fact that there was no readily discernable market for any such equipment, should it be stolen.

With the opening of the 27 mhz (11 meter) band to any citizen without the need for a technical examination, the "population explosion" in this "citizens band" has been phenomenal. As a result, millions of transceivers are now in all types of motor vehicles ranging from sportscars to eighteen wheel tractor trailers. Unfortunately, accompanying the growth in citizen band (CB) radio use has been an equally dramatic increase in theft of CB equipment from automobiles. The theft of CB equipment is now so frequent that an additional auto insurance premium is commonly required to cover a mobile transceiver.

The one characteristic that draws attention to a CB equipped automobile is the antenna. Since a vertical antenna or radiator is not generally an efficient antenna, various configurations are available to improve its efficiency. For example, a $\frac{5}{8}$ wavelength antenna properly matched and tuned, exhibits a gain of about 4.5 db. over a reference $\frac{1}{4}$ wavelength antenna. However, the $\frac{5}{8}$ wavelength antenna is about 22.5 feet long when cut for the center of the 27 mhz band, while a $\frac{1}{4}$ wavelength antenna is about 9 feet long. A 9 feet antenna on a motor vehicle becomes very obvious and conspicuous and thus makes the vehicle more susceptible to theft. Some attempts to "hide" the antenna have been unsuccessful due to the degradation of radiated signal below the level of the reference $\frac{1}{4}$ wavelength antenna. Sharing the CB antenna with the AM or FM radio antenna is unsatisfactory due to the wide disparity between the operating frequencies and the inability to match the output impedance of the transceiver to the impedance of the broadcast band antenna that is required to operate efficiently in the 27 mhz band.

One means of matching the output impedance of a transmitter to an antenna that has long been used by Ham radio operators is a tuner for random length wire antenna. It consists of a shunt capacitor connected between the fed end of the wire and ground and a series capacitor connected between the transmitter and the fed end of the antenna. This type of tuner has normally been used with an antenna having a length that is at least one wavelength at the operating frequency. To use an antenna length significantly less than $\frac{1}{4}$ a wavelength at the operating frequency would severly restrict the usuable bandwidth of the antenna, that is, the ability to operate with a voltage standing wave radio (VSWR) below about 3:1. However, such a narrow bandwidth characteristic may be overcome by the use of a "capacitive hat" connected to the distal or high impedance end of a vertical antenna. This provides for a reduction in the quality (Q) of the antenna and also serves to prevent high amounts of RF voltage from appearing at the distal end. In addition, such a short antenna is attractive in that it is not readily noticed and is unobtrusive.

SUMMARY OF THE INVENTION

The present invention relates to radio frequency radiators, and more particularly, to an improved antenna and coupler system particularly suited for installation in a motor vehicle or automobile. Thus as one important feature, the present invention provides an improved antenna system that mounts adjacent a window of an automobile and which incorporates an antenna having only a fraction of the length of a $\frac{1}{4}$ wavelength at the operating frequency. As another important feature, the present invention provides such an antenna system which may be conveniently installed in the rear trunk of an automobile and which may be readily coupled to a transceiver with a relatively low VSWR. The antenna system of the invention further exhibits sufficiently broadbanded characteristics and provides for protecting the matching components from undesirable vibration and exposure to being inadvertently damaged.

In accordance with one embodiment of the present invention, the above features are provided by an antenna which has a length significantly shorter than $\frac{1}{4}$ wavelength at the operating frequency. The short antenna is positioned in a vertical plane across the inside surface of the rear window of a motor vehicle or automobile and has its impedance matched to a transmitter within the automobile by means of a shunt variable capacitor connected to the fed end of the antenna through a resistor of predetermined size. This fed end of the antenna and the series connected resistor are also coupled to the transmitter by means of another variable capacitor in series with a coaxial transmission line which extends along the bottom panel of the vehicle body and has a length which is about a half wavelength at the operating frequency. The capacitors are mounted on a board located within a housing which is mounted on the vehicle frame within the trunk compartment of the vehicle. To improve the bandwidth of the antenna, the distal end of the antenna is connected to the body of the vehicle above the rear window so that the body acts as a "capacitive hat."

Other features and advantages of the invention will be apparent from the following description, the accompanying drawing and the appended claims.

DESCRIPTION OF THE PREFERRED EMBODIMENT

Figure 1:
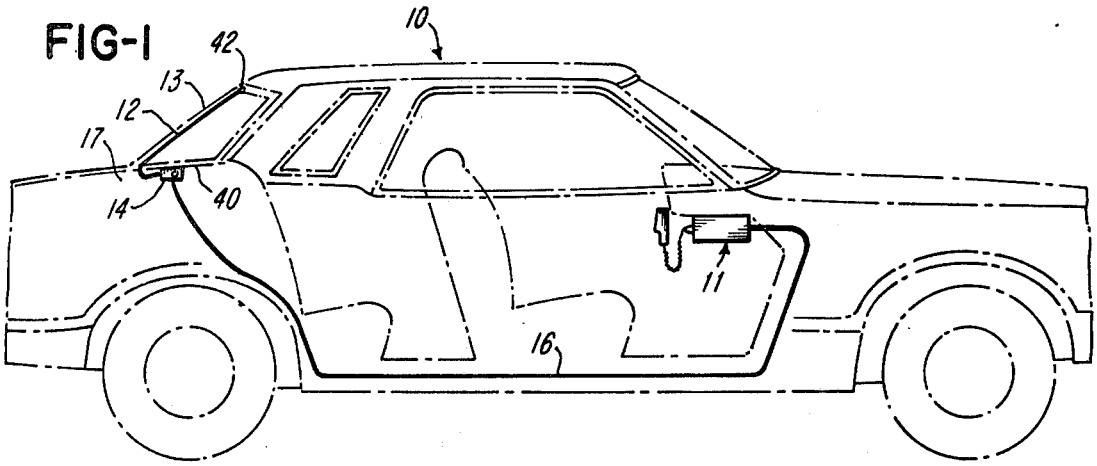
FIG. 1 is a diagrammatic elevational view of an automobile, in part section, and showing an antenna system constructed and installed in accordance with the invention.

Referring now to FIG. 1, a motor vehicle or automobile has a body 10 in which a transceiver 11 is mounted within the dash. A flexible wire antenna 12 is located in the rear of vehicle body 10 and extends in a vertical plane across the inside surface of the rear window panel 13. The lower end of the antenna 12 is coupled to the transceiver 11 by means of a matching and coupling network or tuning unit 14 and a coaxial cable 16 which extends along the floor of the body 10. The cable 16 has a length of about 18 to 20 feet or about ½ the wavelength at 27 mhz in order for the same low output impedance of the transmitter to appear at the fed end of the antenna 12.

Figure 2:
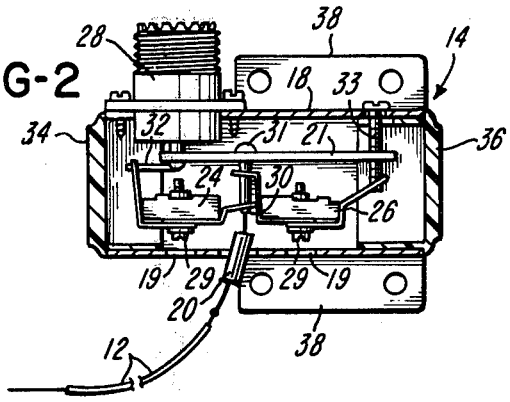
FIG. 2 is a part section view of the coupling and matching unit used in the antenna system shown in FIG. 1.
Figure 3:
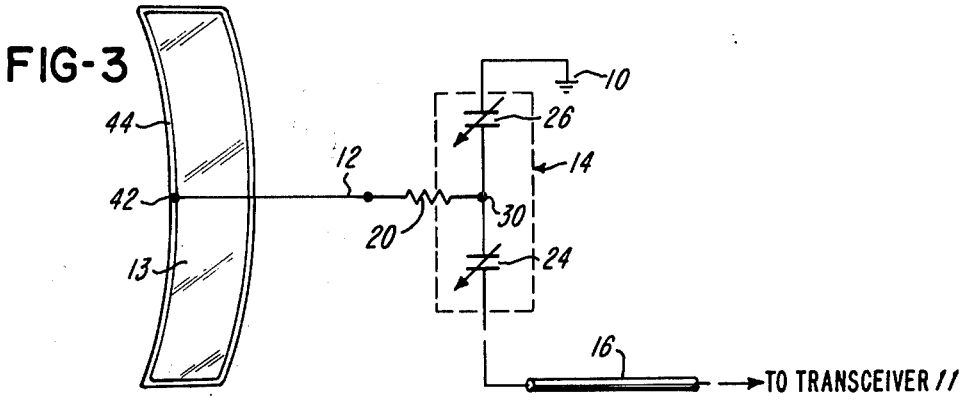
FIG. 3 is a schematic representation of the antenna system shown in FIG. 1, and illustrating the coupling and matching unit and the antenna which extends upwardly across the rear window of the motor vehicle.

Referring to FIG. 2, the matching and coupling network or tuning unit 14 is located within the vehicle trunk compartment 17 and includes a metallic housing 18 having a set of tuning apertures or openings 19. The housing 18 encloses an insulator panel or board 21 on which is mounted a pair of series connected capacitors 24 and 26. An SO-239 type coaxial chassis connector 28 is affixed to one wall of housing 18 for connection with a mating connector on the rearward end of the coaxial cable 16. The series connected capacitors 24 and 26 are variable and are tuned by adjusting corresponding screws 29 respectively with a nonconducting screwdriver extending through the openings 19.

The lower end of the antenna 12 is connected through a resistor 20 to the common node 30 between capacitors 24 and 26, and the node terminals are secured to the supporting panel or board 21 by a stud 31. One end of the capacitor 24 is connected to the center conductor 32 of the coaxial connector 28, and the corresponding end of capacitor 26 is grounded to the housing 18 by means of a screw 33 which also supports one end of the board 21. The opposite end of the board 21 is supported by the center conductor 32 of the coaxial connector 28. The resistor 20 is rated between 5 and 20 ohms and preferably at 10 ohms at one-half watt. The resistor 20 is supported by the housing 18 and is surrounded by a shrink plastic tube (not shown) which extends through a hole within the housing.

A set of plastic end caps 34 and 36 are pressed into opposite end portions of the housing 18 and are cemented to close the housing so that foreign matter is substantially prevented from entering the housing and effecting capacitors 24 and 26. The metal housing 18 includes a base mounting plate forming outwardly projecting ears or flanges 38. The flanges 38 are secured by screws (not shown) to the vehicle body 10 directly under the rear deck 40 below the rear window panel 13 so that the housing 18 is grounded to the body 10.

As mentioned above, the coaxial cable 16 has its forward end connected to transceiver 11 and its rearward end connected through connector 28 to the coupler and matching network or tuning unit 14. The series connected variable capacitors 26 and 28 have one end grounded to the body 10 through the housing 18, and the opposite end is connected to cable 16 through the center conductor 32. The common ends of the capacitors or node 30 is connected to the fed end of the antenna 12 through the resistor 20, and the distal end of antenna 12 is connected to the vehicle body 10 by a screw 42 which extends through the frame 44 surrounding the rear window panel 13. Typically, the distance along the rear window panel 13 in a vertical plane is about 18 inches which represents about 4% of a wavelength at 27 mhz.

While the antenna system herein described constitutes a preferred embodiment of the invention, it is to be understood that the invention is not limited to this precise system, and that changes may be made therein without departing from the scope and spirit of the invention as defined in the appended claims.

The invention having thus been described, the following is claimed:

1. In combination with a motor vehicle including a metal body surrounding a rear window panel and defining a trunk compartment below the window panel, and a transceiver disposed within the body and capable of functioning within a band of operating frequencies, an improved antenna system for the transceiver, comprising a set of two capacitors closely coupled in series with a common node therebetween, a housing enclosing the series connected capacitors, means within said housing and supporting said capacitors, a coaxial cable having a center electrical conductor connecting one end of the series connected capacitors to the transceiver, means on said housing for electrically connecting the opposite end of said series connected capacitors directly to said vehicle body, means for securing said housing to the vehicle body within the trunk compartment below the rear window panel, an elongated metal radiator element having a fed end and a distal end spaced from said fed end, a resistor connecting said fed end of said radiator element to said series connected capacitors at the common node, said radiator element extending within the vehicle body upwardly from said housing and across the inner surface of the rear window panel, and said distal end of said radiator element being electrically connected to the vehicle body above the rear window panel.

2. The antenna system of claim 1 including a coaxial chassis connector having a body portion electrically connected to and mounted on said housing and having a center conductor connected to said one end of the series connected capacitors, and said other end of the series connected capacitors is connected to said housing.

3. The antenna system of claim 1 wherein each of said capacitors is variable, and said housing has aperture means aligned with the respective capacitors to facilitate tuning of said capacitors.

4. The antenna system of claim 1 wherein said resistor has a rating between five and twenty ohms.

5. The antenna system of claim 1 wherein said housing comprises a metal tubular portion, and a set of end caps secured to opposite ends of said tubular portion.

6. The antenna system of claim 1 wherein said support means includes an electrical insulator board supporting said capacitors, a coaxial cable connector extending into said housing and having a center conductor supporting a portion of said board.

7. The antenna system of claim 6 wherein connecting means include a metal fastener supporting another portion of said board and forming an electrical conductor between said opposite end of said series connected capacitors of said housing.

* * * * *